United States Patent [19]

Weiland

[11] Patent Number: 4,807,450

[45] Date of Patent: Feb. 28, 1989

[54] WARP KNITTING MACHINE WITH WEFT INSERTION ARRANGEMENT

[75] Inventor: Jakob Weiland, Rodgau, Fed. Rep. of Germany

[73] Assignee: Karl Mayer Textilmaschimenfabrik GmbH, Obertshausen, Fed. Rep. of Germany

[21] Appl. No.: 202,195

[22] Filed: Jun. 3, 1988

[30] Foreign Application Priority Data

Jun. 19, 1987 [DE] Fed. Rep. of Germany ..... 3720348

[51] Int. Cl.[4] ..... D04B 23/06

[52] U.S. Cl. ..... 66/84 A

[58] Field of Search ..... 66/85 A, 84 A

[56] References Cited

U.S. PATENT DOCUMENTS 3,774,414 11/1973 Vogel ..... 66/84 A 4,437,323 3/1984 Hittel et al. ..... 66/84 A 4,442,684 4/1984 Bergmann et al. ..... 66/84 A 4,571,956 2/1986 Fiedler ..... 66/84 A

*Primary Examiner*—Ronald Feldbaum

*Attorney, Agent, or Firm*—Omri M. Behr

[57] ABSTRACT

A warp knitting machine can deliver weft threads along a weft path to a needle bed having a needle bar. The machine has a weft thread magazine for transversely laying the weft threads across the breadth of the machine, in parallel, on the weft path, and upstream of the needle bed. The machine has at least one forwarding device for protruding into the weft path and through the needle bed for separating a leading one of the weft threads and bringing it to the downstream side of the needle bed, at least one support element for the weft threads having a support surface directed towards the needle bed. Also included is a vibration element connected to the weft thread support element.

7 Claims, 2 Drawing Sheets

WARP KNITTING MACHINE WITH WEFT INSERTION ARRANGEMENT

BACKGROUND OF THE INVENTION

The present invention is concerned with a warp knitting machine having (a) a weft thread magazine with at least two transport arrangements which move the weft threads towards the needles, (b) weft thread forwarding means which individually deliver the weft threads onto the rear side of the needle bed and (c) a transport assistance arrangement which comprises, at least one support element having a support surface for the weft threads, extending in the forwarding direction.

It has been found that in warp knitting machines of large working breadth, it is not possible to maintain the tension in the weft threads, which run from one forwarding means over the entire machine breadth to another forwarding means, at a sufficient level that the weft threads do not sag in the middle. This danger of sag is particularly serious with heavy threads or with threads of high elasticity. If a weft thread sags, however, there is no way to insure that it will be securely grasped by the weft thread forwarding means and brought to the rear of the needle bed.

In warp knitting machine of the Prior Art (DE-PS 24 32 252) the sagging is prevented by means of support elements which are formed either by the upper side of a conical winding spindle or by the underside of a conical winding spindle working together with a wire frame. In both cases the weft threads are transported to the knitting needles in the rotating notches of the winding spindle. This turning drive adds considerably to the capital cost of the machine furthermore, in order to introduce the weft threads into the winding slots an additional set of slotted wheels is required.

If one does not provide rigid support during the forward transportation of the weft threads, a more or less large degree of friction arises between the weft threads and the support surfaces during the weft thread transportation step which is dependent upon the nature of the upper surface of the thread. This friction operates as a braking force on weft threads so that the weft threads in the middle section of the machine trail with respect to the thread segments proximate to the two transport arrangement at the edges of the machine. This braking force raises the thread tension to the point that the tension overrides the braking force and the threads snap forward in an uncontrolled manner. Since this occurs differently with individual threads and in an uncontrolled manner, the resultant thread distribution brings about a substantial change in the thread spacing particularly in the middle segment between the two transport arrangements so that inconsistencies arise in the placement of the weft threads.

The purpose of the invention is to provide a warp knitting machine of the prior art which insures a trouble free provision of the threads to the thread forwarding means at a lower mechanical cost.

SUMMARY OF THE INVENTION

In accordance with the illustrative embodiment demonstrating features and advantages of the present invention, there is provided a warp knitting machine for delivering weft threads along a weft path to a needle bed having a needle bar. The machine includes a weft thread magazine for transversely laying the weft threads across the breadth of the machine, in parallel, on the weft path, and upstream of the needle bed. Also included is at least one forwarding means for protruding into the weft path and through the needle bed for separating a leading one of the weft threads and bringing it to the downstream side of the needle bed. The machine also includes at least one support element for the weft threads having a support surface directed towards the needle bed. Also included is a vibration element connected to a the weft thread support element.

By employing apparatus of the foregoing type, an improved thread transport is achieved. In a preferred embodiment, a vibratory element vibrates a thread support element near the needle bed. It is even more advantageous to provide a plurality of supported sinkers as support elements between two transport arrangements. Since the frictional factor is reduced by the vibration, such a plurality of supports is permissible.

It is particularly desirable to provide that the support surfaces are directed downwardly in the direction of the needle bed, the bias of the support surface in connection with the vibratory movement then gives an effective force in the forwarding direction. The arrangement of the weft threads is therefore substantially improved. By an appropriate choice of the angular bias and/or the vibratory frequency, it is possible to bring even weakly tensioned weft threads to a substantially linear orientation.

BRIEF DESCRIPTION OF THE DRAWINGS

The following drawings illustrate the preferred embodiments of the invention.

DETAILED DESCRIPTION OF THE DRAWINGS

Figure 1:
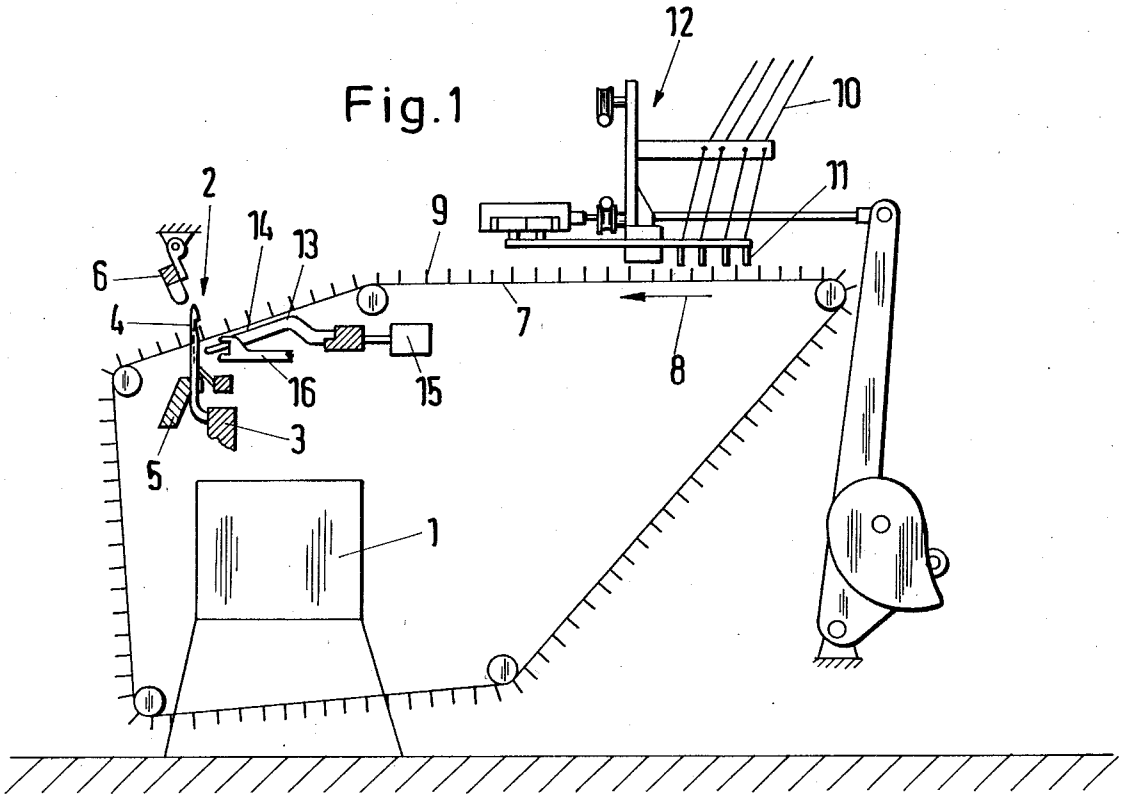
FIG. 1 shows a schematic side elevational view of a warp knitting machine of the present invention.

The warp knitting machine of the present invention comprises a machine frame 1 upon which the working elements described hereinbelow are supported, and a working area 2 in which the stitches are formed. A needle bar 3 carries needles 4 which, in the present embodiment, are illustrated as slider needles. There is further provided a dropper plate 5 and a guidebar 6 for the provision of the warp threads.

Two parallel spaced transport arrangements 7 are provided, of which only one is illustrated in FIG. 1, which move in the direction of arrow 8. The transport arrangements 7 are endless chains carrying outwardly projecting holders 9 which are equally spaced apart from each other. The weft threads 10 are laid parallel to each other in the spaces of transport means 7 by means of thread guides 11 in a thread provision arrangement. Such a thread provision arrangement is known for example, in German Patent No. DE 29 51 6 43. It is also known from U.S. Pat. 4,437,323, the disclosure of which is incorporated herein by reference.

When the thus laid weft threads 10 approach the working area 2 they are supported by a plurality of mutually separated sinker-formed support elements 13 whose upper surfaces 14 serve as the support surface, and which extend to just before the needle bed 4 of the individual needles 4. Each support element 13 is connected to an electromagnetic vibratory element 15 which is controlled by a line frequency of 50 (or 60) Hz Depending upon the form of construction, a vibratory element frequency of 50 to 100 Hz may be provided. This vibration rate. The vibratory elements 15 can be operated mechanically, electromagnetically, pneumatically or in other known ways. The advantage of the electromagnetic vibratory elements is that they are readily constructed and take up a smaller amount of space. If hey are driven with the line frequency of an alternating current system there is provided a highly suitable vibratory element.

In this connection it is advantageous to provide each sinker 13 with a vibratory element. Alternatively, groups of sinkers 13 may be powered by a single vibratory element. Rather then utilizing a single vibratory system with a substantially large mass, there is thus provided a plurality of single vibratory systems with correspondingly smaller mass. This is advantageous for the entire vibratory arrangement of the whole machine. One can avoid the use of a transfer framework which stretches across a substantial portion of the breadth of a knitting machine. The individual vibratory elements have a very small size and can very readily find space for themselves.

The support surface 14 is angularly biased downwardly toward the working area 2. Accordingly weft threads 10 have a tendency to fall forward on surface 14 toward needle bed 2. The weft threads 10 are thus provided with a forward motion not only by the transport arrangement located at their ends, but also by the vibratory motion of the sloped support element 13. The threads thus arrive at the needles 9 in a substantially linear orientation and can there be grasped by the forwarding means 16. These forwarding means 16 are also present in substantial numbers and are distributed over the breadth of the machine. Forwarding means 16 reciprocate with a timing that allows them to protrude into the weft path and through the needle bed 2 to separate successive weft threads and bring them to the needle bed 2.

Figure 2:
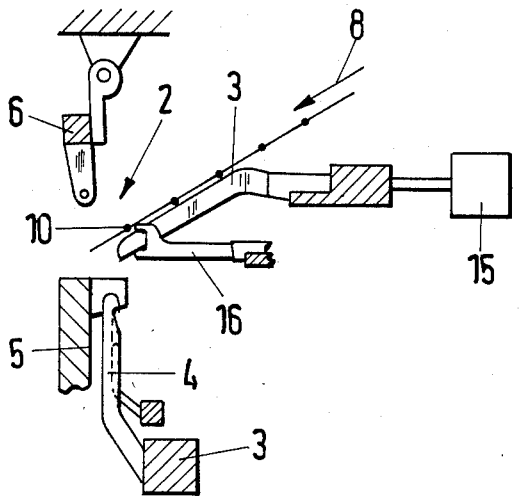
FIG. 2 shows an expanded view of the working area of FIG. 1 wherein the warp thread forwarding means is at the beginning of the cycle.
Figure 3:
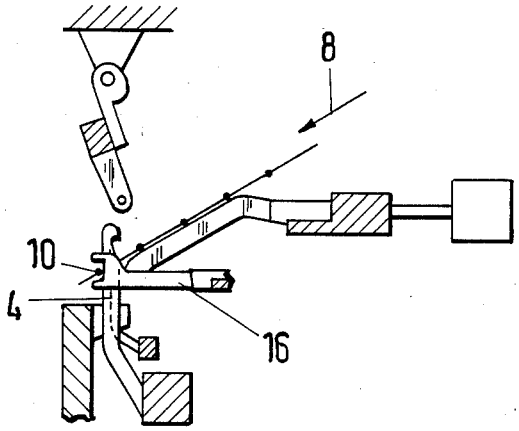
FIG. 3 is a view as in FIG. 2 whereby the forwarding means is at the end of its movement cycle.

To facilitate an understanding of the principles of the present invention. The operation of the apparatus of FIG. 1 will be described in connection with FIGS. 2 and 3. FIG. 2 illustrates how the weft threads are brought toward the needle bed and shows the position of the weft thread forwarder 16 at the beginning of the work cycle. FIG. 3 shows the same arrangement wherein the weft thread forwarder 16 is at the end of its path having brought the weft threads 10 behind the needles 4.

Modern warp knitting machines presently operate under a designated rotational speed of 900 to 1200 revolutions per minute. This corresponds to a working frequency of about 1.5 to 2 Hz. The vibratory frequency of element 15 should be larger than this number. It has been found that even small increases give rise to correspondingly positive results. It is desirable however, that the vibratory frequency be a multiple of the active working cycle frequency. The higher the frequency, the lower will be the vibratory amplitude of the support element required to overcome friction. The specific amplitude and frequency can be chosen based upon the expected weight, friction and handling speed of the chosen weft threads.

In operation weft thread 10 are laid in parallel upon forwarding means 7 which is moving in direction 8. As weft threads 10 approach needle bed 2 they descend at the illustrated angle and are supported from sagging by surface 13.

By providing a vibratory movement to the support elements 14, the weft threads 10 are continually thrown upwardly so that tension caused by dragging threads over a support surface is substantially reduced. Thus, the braking force is eliminated. The trailing and uncontrolled forward snap of the weft threads is totally eliminated or reduced to a level which, for all practical purposes is negligible.

Accordingly, weft threads 10 reach needle bed 2 substantially parallel and with proper timing. Being predictable, forwarding means can move from the position of FIG. 2 to the position of FIG. 3, carrying one of the weft threads 10 to the downstream side of needles 4.

Obviously, many modifications and variations of the present invention are possible in light of the above teachings. It is therefore to be understood that within the scope of the appended claims, the invention may be practiced otherwise than as specifically described.

What is claimed is:

1. A warp knitting machine for delivering weft threads along a weft path to a needle bed having a needle bar, said machine comprising:

a weft thread magazine for transversely laying said weft threads across the breadth of said machine in parallel on said weft path, upstream of said needle bed, a least one forwarding means for protruding into said weft path and through said needle bed for separating a leading one of said weft threads and bringing it to the downstream side of said needle bed, at least one support element for said weft threads having a support surface directed towards said needle bed, and a vibration element connected to a said weft thread support element.

2. A warp knitting machine in accordance with claim 1 wherein said support surface 14 is oriented to be downwardly displaceable in the direction of the needles.

3. A warp knitting machine in accordance with claim 1 wherein a plurality of separated sinkers are located between the transport arrangements are provided as support elements.

4. A warp knitting machine in accordance with claim 3 wherein each sinker is provided with a specific vibration element.

5. A warp knitting machine in accordance with claim 1 wherein the vibration frequency is greater than the working cycle frequency of the machine.

6. A warp knitting machine in accordance with claim 1 wherein the vibration frequency is a multiple of the working cycle frequency.

7. A warp knitting machine in accordance with claim 1 wherein the vibratory element is electronically operated and is driven by the frequency of the alternate current net.

* * * * *